United States Patent [19]

Crosby

[11] 4,297,178

[45] Oct. 27, 1981

[54] RUTHENIUM ELECTROPLATING AND BATHS AND COMPOSITIONS THEREFOR

[75] Inventor: Jeffrey N. Crosby, Worcester, England

[73] Assignee: The International Nickel Company, Inc., New York, N.Y.

[21] Appl. No.: 138,786

[22] Filed: Apr. 9, 1980

[30] Foreign Application Priority Data

Apr. 10, 1979 [GB] United Kingdom ..... 12648/79

[51] Int. Cl.[3] ..... G01N 3/52; C07F 17/02

[52] U.S. Cl. ..... 204/47; 200/262; 260/429 R

[58] Field of Search ..... 204/47, 43 N; 260/429 R; 200/262

[56] References Cited

U.S. PATENT DOCUMENTS

| | | | |
|---|---|---|---|
| 2,057,638 | 10/1936 | Zimmerman et al. | 204/47 |
| 2,600,175 | 6/1952 | Volterra | 204/47 X |
| 3,530,049 | 9/1970 | Scherzer et al. | 204/43 N |
| 3,576,724 | 4/1971 | Reddy et al. | 204/47 |
| 3,625,840 | 12/1971 | Mason et al. | 204/47 |
| 3,692,641 | 9/1972 | Losi et al. | 204/43 N |
| 3,793,162 | 2/1974 | Hope | 204/47 |
| 4,082,622 | 4/1978 | Gebauer | 204/40 |
| 4,082,624 | 4/1978 | Heller et al. | 204/47 |
| 4,082,625 | 4/1978 | Crosby | 204/47 |

FOREIGN PATENT DOCUMENTS

| | | | |
|---|---|---|---|
| 377431 | 4/1973 | U.S.S.R. | 204/47 |

OTHER PUBLICATIONS

F. H. Reid et al., Trans. Inst. Metal Finishing, vol. 38, pp. 45–51, (1961).

G. S. Reddy et al., Trans, Inst. Metal Finishing, vol. 47, pp. 187–193 (1969).

G. A. Conn., Plating, pp. 1038–1040, Sep. 1969.

R. Kulikauskaite et al., Liet. TSR Mokslu Akad. Darb., Ser. B, No. 3, pp. 53–63, (1971).

T. A. Palumbo, Plating & Surface Finishing, pp. 42–44, Aug. 1979.

Chem. Abstracts, vol. 77, p. 573, 13078w, (1972).

*Primary Examiner*—G. L. Kaplan

*Attorney, Agent, or Firm*—Raymond J. Kenny; Miriam W. Leff

[57] ABSTRACT

The invention provides a bath that is operable at, or close to, pH 7 to deposit a coating of ruthenium on a substrate, e.g. the contacts of electrical switches, which does away with the need to provide a protective coating on the substrate prior to ruthenium plating. The bath consists essentially of (i) a compound or a complex that contains a nitrogen bridge linkage joining together two ruthenium atoms and (ii) an aqueous solution of oxalic acid or an oxalate.

34 Claims, No Drawings

RUTHENIUM ELECTROPLATING AND BATHS AND COMPOSITIONS THEREFOR

This invention relates to the electrodeposition of ruthenium and baths therefor.

Electrodeposits of ruthenium possess excellent electrical conductivity and wear resistance during extensive use as coatings for electrical contacts, for example, those in reed switches or relays. In such switches an electrical circuit is made or broken by controlled expansion alloy wires or reeds which are sealed in a glass capsule in an inert atmosphere. At the areas of contact the wires are flattened and then plated prior to sealing into the capsule. Gold has commonly been used as the plating material but more recently it has been proposed to use ruthenium as an alternative in view of its greater hardness, comparable electrical conductivity and wear-resistance and because it is relatively inexpensive.

However, currently available ruthenium electroplating baths suffer from a variety of limitations. For example, U.S. Pat. No. 3,576,724 describes the electrodeposition of ruthenium from a bath comprising an aqueous solution of the anionic complex $[Ru_2N(H_2O)_2Y_8]^{3-}$ where each Y is either chlorine or bromine. Baths of this type must be operated under acidic conditions. In order to form an acceptable deposit it is essential that the pH of the solution does not exceed 4, and commercially operated electrolytes containing this complex commonly have a pH of the order of 1.5. Many metallic substrates, including various controlled expansion nickel-iron alloys used in reed switches and related articles, as well as copper, nickel and the like, can not be satisfactorily plated using these acidic conditions without first applying a protective "flash" coating of gold or other suitable metal to the substrate.

U.S. Pat. No. 4,082,625 describes a ruthenium electroplating bath which can be operated under alkaline conditions and which is satisfactory in many respects. This bath also contains a complex having a nitrogen bridge linkage between two ruthenium atoms which can be represented by the formula Ru=N=Ru, and in this case the complex has the formula $[Ru_2N(NH_3)_8X_2]^{3+}$ where each X is chlorine, bromine or iodine. However, optimum properties are obtained at a generally unsatisfactory high pH of about 12 to 13 and the deposits can have relatively high internal stress which can lead to cracking in deposits as thin as 0.25 μm. Furthermore, unless relatively low anode or cathode current densities are employed, the surface of the deposit may be somewhat rough owing to the formation of solids at the anode.

There is a need therefore for a ruthenium electroplating bath which can be operated under non-acid conditions and which can overcome such problems.

INVENTION

This need is in general satisfied by the present invention which provides an aqueous bath for electroplating ruthenium on a substrate characterized in that it consists essentially of (i) a compound or a complex that contains a nitrogen bridge linkage joining together two ruthenium atoms and (ii) oxalic acid or an oxalate in aqueous solution.

The exact composition of the bath or components of the bath as they exist in solution are not known. It is believed that the ruthenium may react with oxalic acid (or oxalate) in solution. It has been found that treating the bath with excess potassium hydroxide causes precipitation of ruthenium, presumably as a hydroxy complex, and the resulting solid dissolves readily in hydrochloric acid. This solution yields a crystalline solid which can be identified as $K_3[Ru_2N(H_2O)_2Cl_8]$ by comparison of its infrared spectrum with that of the known material. Thus, it is believed that the reaction product, if formed, retains the Ru=N=Ru linkage of the reactant.

For the avoidance of doubt, as used herein, the term "oxalate" is intended to include salts containing the hydrogen oxalate ion.

Preferred baths are prepared by reacting a salt of the complex $[Ru_2N(H_2O)_2X_8]^{3-}$ where each X represents a chlorine or bromine atom, for example the potassium salt $[Ru_2N(H_20)_2Cl_8]K_3$, with oxalic acid or an oxalate in aqueous solution. It is not necessary for all the ligands in the complexes to be the same, and a complex containing mixed chlorine and bromine is acceptable. The reaction can be readily effected at or slightly below the solution boiling point. If the reaction is carried out in acidic solution, the pH must be adjusted subsequently to a non-acidic value by use of a suitable base which can conveniently be potassium hydroxide.

Other salts of this particular complex may of course be employed and, although salts of the complex $[Ru_2N(H_2O)_2X_8]^{3-}$ are preferred, other complexes containing a nitrogen bridge linkage can alternatively be employed. In theory, any supporting cation can be used, but the ammonium ion, although it works, gives rise to problems resulting from the evolution of ammonia in slightly basic plating baths. Thus, it is preferred to use ammonium-free baths.

The amount of ruthenium present in the bath should be at least 1.0 g/l and is preferably at least 1.6 g/l (equivalent to approximately 5 g/l of the compound $[Ru_2N(H_20)_2Cl_8]K_3$) to achieve a high current efficiency in operation of the bath. Although high ruthenium concentrations up to the solubility limit of the complex formed may be employed, there is little additional benefit in terms of current efficiency above 3.5 g/l of ruthenium. However, in order to avoid the necessity of frequently replenishing the bath, it is preferred to use a ruthenium concentration of 6.1 g/l (equivalent to approximately 20 g/l of the compound $[Ru_2N(H_2O)_2Cl_8]K_3$).

Concentrations of oxalate ions in the bath must be high and generally at least 20 g/l are required, e.g. for stability, and preferably at least 40 g/l. Most preferably the amount present in the bath is near the maximum oxalate that can be satisfactorily contained. For example, when potassium hydroxide is present in the bath, the oxalate content is dependent on the solubility of potassium oxalate.

The pH of the bath is important. For the reasons given above, it is an advantage of the bath that it is operated under non-acid conditions. Furthermore, although ruthenium deposition will occur from the present bath at pH values below about 7, the efficiency of the metal deposition process decreases as the pH is reduced below that value. Preferably the pH does not exceed 10 because above this value there is a tendency for the bath to become chemically unstable. Optimum plating rates are obtained at pH values of 7.5 to 9 and most preferably the pH is from 7.5 to 8. A great advantage of the bath, therefore, is that optimum operation is achieved at mildly alkaline pH values which are the most convenient pH values from a practical point of view.

Another particular advantage of the process is that a wide range of cathode current densities can be employed. Plating of precious metals is usually done at cathode current densities below 2 A/dm$^2$, but with the bath according to the present invention, relatively high cathode current densities can be used since they do not generally cause deterioration of the deposit or a considerable fall in cathode efficiency. Cathode current densities in the range of 0.5 to 10 A/dm$^2$ have been successfully employed.

The bath can be operated at all normal temperatures from room temperature upwards. Solubility of the bath components may be enhanced by operating at elevated temperatures. There is no particular advantage above 70° C. and in addition the disadvantages of high evaporation rates become significant. Cathode efficiencies increase with increasing temperature and a preferred temperature is between 50° and 70° C. An optimum temperature is 60° C. because the rate of increase above this temperature has been found to be marginal.

In operation of the bath, any suitable insoluble anodes may be employed including those of platinum or platinized titanium. Gentle agitation of the bath is preferred when using cathode current densities of 3 A/dm$^2$ or higher and may also be used at current densities below 3 A/dm$^2$, but agitation of the bath when using the lower current densities will give lower cathode efficiencies than those obtained from a non-agitated solution. Cathodes should clearly be made of a material not attacked by the bath solution. Copper cathodes are particularly suitable.

Plating can be carried out in a single compartment cell, but it has been found that this leads to a gradual reduction in the cathode efficiency during electroplating. The exact cause of this reduction in cathode efficiency is not known but it is thought to be due to anodic oxidation of ruthenium. The bath can be rejuvenated and the cathode efficiency restored to its original value by acidifying the bath, preferably with oxalic acid. The rejuvenation can be speeded up by heating the bath preferably to a temperature just below its boiling point for, for example, 30 minutes. Before reusing the bath after rejuvenation, it should be adjusted to a slightly alkaline state. Although satisfactory operation can be achieved by subjecting a bath to alternate steps of electrolysis and rejuvenation, the life of the bath is limited because in each rejuvenation step it is necessary to add more oxalic acid than is used up in the electrolysis. Eventually, the bath becomes saturated with potassium oxalate and must be discarded.

We have found, however, that the reduction in cathode efficiency can be avoided by use of a divided cell in which the ruthenium bath is the catholyte. The anolyte is preferably ruthenium-free and, in order to avoid the contamination of the catholyte by migration across the cell's dividing membrane or diaphragm, preferably contains oxalic acid. It is especially advantageous to use a dilute aqueous solution of oxalic acid having such a pH that hydrogen ions migrate across the dividing membrane or diaphragm at the same rate as hydrogen is evolved at the cathode, thereby maintaining the pH of the catholyte at a constant value. An aqueous solution of oxalic acid dihydrate having a pH of 2 has been found to be suitable.

The membrane of diaphragm dividing the anolyte from the catholyte may be, for example, a porous ceramic pot, a polystyrene-based ion-selective membrane, or a perfluorosulfonic acid-based ion-selective membrane, for example a NAFION (a du Pont Trademark) membrane.

Operation in a divided cell has proved satisfactory in providing high and steady levels of cathode efficiency for several bath turnovers without any sign of deterioration. The only attention required to the catholyte being an occasional pH adjustment with, for example, oxalic acid or potassium hydroxide, and occasional replenishment to maintain the ruthenium concentration within a desired range.

To exemplify baths of the invention, a solution was prepared by mixing 20 g/l of $[Ru_2N(H_2O)_2Cl_8]K_3$ (≃6.2 g/l of ruthenium) and 80 g/l of oxalic acid in water and maintaining the solution at a temperature slightly below its boiling point for one hour. The pH was then adjusted to 7.5 by the addition of a 30% potassium hydroxide solution. Plating was then carried out from a divided cell containing this solution (after filtration) as catholyte and a solution containing 1.0 g/l oxalic acid dihydrate as anolyte and employing platinum sheet anodes and copper cathodes 2.54 cm in diameter (10 cm$^2$ total surface area). The material used to divide the cell was a NAFION cation-selective perfluorosulfonic acid membrane. The bath temperature was 60° C. The Table shows the results of the plating tests carried out over a range of current densities and illustrates the effect of current density on the plating rate and cathode efficiency.

TABLE

| Cathode Density Density (A/dm$^2$) | Agitation (Yes or No) | Plating Rate (μm/hour) | Cathode Efficiency (%) |
|---|---|---|---|
| 1 | No | 6.4 | 84 |
| 1 | Yes | 2.6 | 34 |
| 2 | No | 12.8 | 84 |
| 2 | Yes | 9.4 | 61 |
| 3 | Yes | 14.6 | 64 |
| 4 | Yes | 21.6 | 71 |
| 4 | No | 21.2 | 70 |
| 5 | Yes | 21.4 | 56 |
| 6 | Yes | 22.6 | 50 |
| 7 | Yes | 23.8 | 45 |
| 8 | Yes | 25.4 | 42 |

Deposits from these baths were in all cases in excess of 1 μm thick and were smooth and crack-free. The crack-free nature of the deposits in particular illustrates that their internal stress is relatively low compared with the highly stressed deposits obtained with previous non-acidic ruthenium plating baths.

It is noted that the ruthenium complex $[Ru_2N(H_2O)_2Cl_8]^{3+}$, per se, precipitates out at a pH greater than 7, and a pH of 4 or less is usually used for plating ruthenium from a bath using such complex. However, in the presence of oxalic acid and an hydroxide the electrodeposition of ruthenium can be carried out effectively not only at pH's greater than 4, but advantageously at pH's close to neutral, e.g. a pH of about 6, and preferably on the alkaline side. It is believed that this behavior of the bath is different from that which would be expected from the ruthenium complex and oxalic acid or an oxalate uncombined. It is noted that the bath is operable and effective without additional additives, e.g. a sulfamate such as ammonium sulfamate or any other ammonium ion. Conveniently the bath may be in concentrated form containing, e.g. at least 12 grams per liter of ruthenium, and diluted with, e.g. sufficient water, oxalic acid, an oxalate, and/or an hydroxide to provide a bath having a composition consisting essentially of at least ruthenium in the amount of 1 g/l to less than about 12 g/l, an oxalate moiety in the amount of at least 20 g/l to its solubility limit and sufficient hydroxide to provide the desired pH, e.g. of about neutral up to about 10.

The foregoing specification is written with specific reference to oxalic acid or an oxalate as a required additive. It will be understood that other polybasic organic acids or salts, e.g. malonic acid may be substituted for oxalic acid. Also, it is to be understood that further modifications and variations may be restored to without departing from the spirit and scope of the invention, as those skilled in the art will readily understand. Such modifications and variations are considered to be within the purview and scope of the invention and appended claims.

What is claimed is:

1. An aqueous non-acidic bath for electrodepositing ruthenium characterized in that it comprises the product of a reaction between (i) a compound or a complex that contains a nitrogen bridge linkage joining together two ruthenium atoms and (ii) oxalic acid or an oxalate in aqueous solution.

2. A bath as claimed in claim 1, characterized in that the compound or complex reacted with the oxalic acid or oxalate is a salt of the complex $(Ru_2N(H_2O)_2X_8)^{3-}$, where each X represents either a chlorine or a bromine atom.

3. A bath as claimed in claim 2, characterized in that the compound or complex reacted with the oxalic acid or oxalate is a salt of the complex $(Ru_2N(H_2O)_2Cl_8)^{3-}$.

4. A bath as claimed in claim 1, characterized in that the amount of ruthenium it contains is not less than about 1.6 g/l.

5. A bath as claimed in claim 4, characterized in that the amount of ruthenium it contains is about 6.1 g/l.

6. A bath as claimed in claim 1, characterized in that the concentration of oxalate ions or of oxalic acid is not less than 40 g/l.

7. A bath as claimed in claim 1, characterized in that the pH of the bath is in the range of from about 7.5 to about 9.

8. A bath as claimed in claim 7, characterized in that its pH is in the range of from about 7.5 to about 8.

9. A bath as claimed in claim 1, characterized in that the reaction product is neutralized with an hydroxide.

10. A bath as claimed in claim 9, characterized in that the hydroxide is an alkali metal hydroxide.

11. A process of coating a conductive substrate with ruthenium which comprises passing an electric current through a bath that contains ruthenium using the substrate as a cathode, characterized in that the bath is as claimed in claim 1.

12. An aqueous bath for electrodepositing ruthenium consisting essentially of ruthenium in the amount of at least 1 g/l to its solubility limit, an oxalate moiety in the amount of at least about 20 g/l to its solubility limit, said bath having a pH in the range of above 4 up to about 10, provided that the ruthenium component is provided as a compound or a complex that contains a nitrogen bridge linkage joining together two ruthenium atoms.

13. An aqueous bath for electrodepositing ruthenium as claimed in claim 12, characterized in that the bath contains a reaction product between (i) said ruthenium component and (ii) oxalic acid or a oxalate.

14. A bath for electrodepositing ruthenium as claimed in claim 12, characterized in that the pH is about 7 up to about 10.

15. An aqueous bath for electrodepositing ruthenium as claimed in claim 12, characterized in that the bath is essentially free of ammonium ion.

16. An aqueous bath for electrodepositing ruthenium as claimed in claim 12, characterized in that the bath is essentially sulfamate-free.

17. A process of coating a conductive substrate with ruthenium which comprises passing an electric current through an aqueous bath that contains ruthenium using the substrate as a cathode, characterized in that the bath has a pH in the range of above 4 up to about 10, consists essentially of ruthenium in the amount of at least 1 g/l to its solubility limit, an oxalate moiety in the amount of at least about 20 g/l to its solubility limit, provided that the ruthenium component is provided as a compound or a complex that contains a nitrogen bridge linkage joining together two ruthenium atoms.

18. A process as claimed in claim 17, characterized in that the process is carried out with the bath at a temperature in the range of from about 50° to about 70° C.

19. A process as claimed in claim 17, characterized in that it is carried out in a divided cell with the said bath as catholyte.

20. A process as claimed in claim 19, characterized in that the anolyte is a dilute ruthenium-free solution of oxalic acid.

21. A process as claimed in claim 21, characterized in that the pH of the anolyte is about 2.

22. A composition of matter adapted to be used in aqueous solution as an electroplating bath comprising as components:

(a) a ruthenium-containing material having two ruthenium atoms linked by a nitrogen bridge atom, and (b) a water-soluble compound from the group oxalic acid, alkali metal salts of oxalic acid and alkali metal acid salts of oxalic acid.

23. A composition of matter adapted to be used in aqueous solution as an electroplating bath as claimed in claim 22, characterized in that the aqueous solution has a pH in the range of above 4 up to about 10.

24. An aqueous bath for electrodepositing ruthenium consisting essentially of as components:

a. a ruthenium-containing material having two ruthenium atoms linked by a nitrogen bridge atom, and b. a water-soluble compound selected from the group consisting of a dibasic carboxylic acid, alkali metal salts of such acid, and alkali metal acid salts of such acid;

said bath having a pH in the range of above 4 up to about 10.

25. An aqueous bath as claimed in claim 24, characterized in that the carboxylic acid is an aliphatic dibasic acid.

26. An aqueous bath as claimed in claim 21, characterized in that the aliphatic dibasic acid is malonic acid.

27. An aqueous bath as claimed in claim 26, characterized in that the bath is essentially free of ammonium ion.

28. An aqueous bath as claimed in claim 26, characterized in that the bath is essentially sulfamate-free.

29. An aqueous bath as claimed in claim 24, characterized in that the bath is non-acidic.

30. An aqueous non-acidic bath for electrodepositing ruthenium characterized in that it comprises the product of a reaction between (i) $(Ru_2N(H_2O)_2X_8)^{3-}$, where X represents either a chlorine or a bromine atom, and (ii) a dibasic carboxylic acid or carboxylate in aqueous solution, and characterized further in that the pH is in a range up to about 10.

31. An aqueous non-acidic bath for electrodepositing ruthenium characterized in that it comprises the product of a reaction between (i) $(Ru_2N(H_2O)_2X_8)^{3-}$, where X represents either a chlorine or a bromine atom, and (ii) oxalic acid or an oxalate in aqueous solution, and characterized further in that the pH is in a range up to about 10.

32. A process of coating a conductive substrate with ruthenium which comprises passing an electric current through an aqueous bath that contains ruthenium using the substrate as a cathode, characterized in that the bath has a pH in the range of about 4 up to about 10 and consists essentially of ruthenium in the amount of at least 1 g/l to its solubility limit, a carboxylate moiety selected from the group consisting of dibasic carboxylic acid, carboxylate, or combination thereof in the amount of at least about 20 g/l to its solubility limit, provided that the ruthenium component is provided as a compound or a complex that contains a nitrogen bridge linkage joining together two ruthenium atoms; and characterized in that said process is carried out in a divided cell with said bath as catholyte.

33. A process as claimed in claim 32, characterized further in that the anolyte is a dilute ruthenium-free solution of a carboxylic acid.

34. A process as claimed in claim 32, characterized in that the pH of the anolyte is about 2.

* * * * *